US009803660B1

(12) United States Patent
Hansell et al.

(10) Patent No.: US 9,803,660 B1
(45) Date of Patent: Oct. 31, 2017

(54) LOW FRICTION COMPACT SERVO PISTON ASSEMBLY

(71) Applicant: DANFOSS POWER SOLUTIONS INC., Ames, IA (US)

(72) Inventors: Jeffrey C. Hansell, Boone, IA (US); Joseph R. Wright, Ames, IA (US)

(73) Assignee: DANFOSS POWER SOLUTIONS INC., Ames, IA (US)

( * ) Notice: Subject to any disclaimer, the term of this patent is extended or adjusted under 35 U.S.C. 154(b) by 344 days.

(21) Appl. No.: 14/172,171

(22) Filed: Feb. 4, 2014

(51) Int. Cl.
*F04B 1/29* (2006.01)
*F15B 13/00* (2006.01)
*F04B 1/32* (2006.01)

(52) U.S. Cl.
CPC ..... *F15B 13/00* (2013.01); *F04B 1/295* (2013.01); *F04B 1/324* (2013.01)

(58) Field of Classification Search
CPC ..... F15B 13/00; F15B 13/0835; F04B 1/04; F04B 1/295; F04B 1/2078; F04B 1/324; F16H 61/443; F16H 61/438
USPC ..... 92/12.2, 13, 165 R, 130 C, 150, 151, 71; 74/60; 91/505, 471; 60/492, 444, 447, 60/487; 417/258, 260, 264
See application file for complete search history.

(56) References Cited

U.S. PATENT DOCUMENTS 2,223,792 A * 12/1940 Muir ..... B23Q 5/268 91/264
3,146,684 A * 9/1964 Vanderhoof ..... F15B 15/1414 92/163
3,713,755 A * 1/1973 Scheffer ..... F04B 1/02 417/258
3,739,692 A * 6/1973 Bell ..... F04B 1/324 91/506
4,075,841 A * 2/1978 Hamma et al. ..... F16H 61/433 60/444
4,463,559 A * 8/1984 Holdenried ..... F16H 61/433 137/625.17
4,978,284 A * 12/1990 Cook et al. ..... F04B 1/02 417/415
5,406,878 A * 4/1995 Freeman et al. ..... F01B 3/108 417/222.1
5,971,717 A * 10/1999 Berthold ..... F01B 3/0052 417/269

(Continued)

FOREIGN PATENT DOCUMENTS

CN 101313148 A 11/2008
CN 101743400 6/2010

(Continued)

OTHER PUBLICATIONS

Japanese Office Action dated Nov. 22, 2016, Japanese Patent Appl. No. 2016-539678; Danfoss Power Solutions.

(Continued)

*Primary Examiner* — F. Daniel Lopez
*Assistant Examiner* — Dustin T Nguyen
(74) *Attorney, Agent, or Firm* — Zarley Law Firm, P.L.C.

(57) ABSTRACT

A servo piston assembly having a servo piston body mounted within a servo piston cylinder. A pair of bushings are mounted within each end of the servo piston body. An elongated bore extends through the servo piston body and receives a guide rod that extends out of the servo piston body and is received within the servo piston cylinder.

5 Claims, 2 Drawing Sheets

(56) References Cited

U.S. PATENT DOCUMENTS

| | | | | |
|---|---|---|---|---|
| 6,553,891 | B2 * | 4/2003 | Fiebing et al. | F04B 1/324 91/506 |
| 7,380,492 | B2 * | 6/2008 | Thoms et al. | F04B 1/324 92/12.2 |
| 8,074,558 | B2 * | 12/2011 | Knussman et al. | F01B 3/102 92/12.2 |
| 8,608,454 | B2 * | 12/2013 | Wanschura et al. | F03C 1/0628 417/269 |
| 8,677,886 | B2 | 3/2014 | Cronin et al. | |
| 2002/0088343 | A1 * | 7/2002 | Schult | F15B 15/223 92/165 R |
| 2010/0156202 | A1 * | 6/2010 | Hoogerhyde | H02K 33/16 310/20 |
| 2011/0094214 | A1 * | 4/2011 | Nelson et al. | F15B 11/0365 60/492 |
| 2012/0038887 | A1 * | 2/2012 | Reed | A61B 3/0285 351/240 |

FOREIGN PATENT DOCUMENTS

| | | | |
|---|---|---|---|
| CN | 101821504 | A | 9/2010 |
| EP | 0896151 | A2 | 10/1999 |

OTHER PUBLICATIONS

Ohinese Office Action issued by the State Intellectual Property Office (SIPO) dated Oct. 9, 2016; Chinese Patent Application No. 201580001690.5; Danfoss Power Solutions.
CN101313148A—English_Abstract.
CN101821504A—English_Abstract.
CN101743400A—English_Abstract.

* cited by examiner

LOW FRICTION COMPACT SERVO PISTON ASSEMBLY

BACKGROUND OF THE INVENTION

This invention is directed toward a servo piston and more particularly a low friction compact servo piston assembly for swashplate style hydrostatic pumps and motors.

Servo pistons are well known in the art. Typically, servo pistons and their connection to a swashplate are designed to minimize the reaction forces between the servo piston and it's guiding bore to reduce the frictional force resisting the piston's motion. This frictional force is a significant contributor to hysteresis in piston position as commanded by the displacement control system. Friction between the piston and it's guiding bore also lead to wear and reduced component life.

With transverse axis servo pistons, where the servo piston axis is perpendicular to shaft axis, it is typical to use cradle type swashplate bearings instead of 360° bearings. While the servo piston may occupy the vacated space of the 360° bearing, the disadvantage is that the cradle type bearings are custom and more expensive than standard catalog bearings.

In order to use standard bearings and still meet power density requirements, the servo piston must be designed to make use of available space. Therefore a need exists in the art for a device that addresses these deficiencies.

An objective of the present invention is to provide a servo piston assembly that is compact and low friction.

Another objective of the present invention is to provide a servo piston assembly that is inexpensive to manufacture.

These and other objectives will be apparent to one skilled in the art based upon the following written description, drawings, and claims.

SUMMARY OF THE INVENTION

A servo piston assembly having a servo piston body mounted within a servo piston cylinder. A pair of bushings are mounted within each end of the servo piston body. An elongated bore extends through the servo piston body and receives a guide rod that extends out of the servo piston body and is received within the servo piston cylinder.

DETAILED DESCRIPTION OF THE PREFERRED EMBODIMENT

Figure 1:
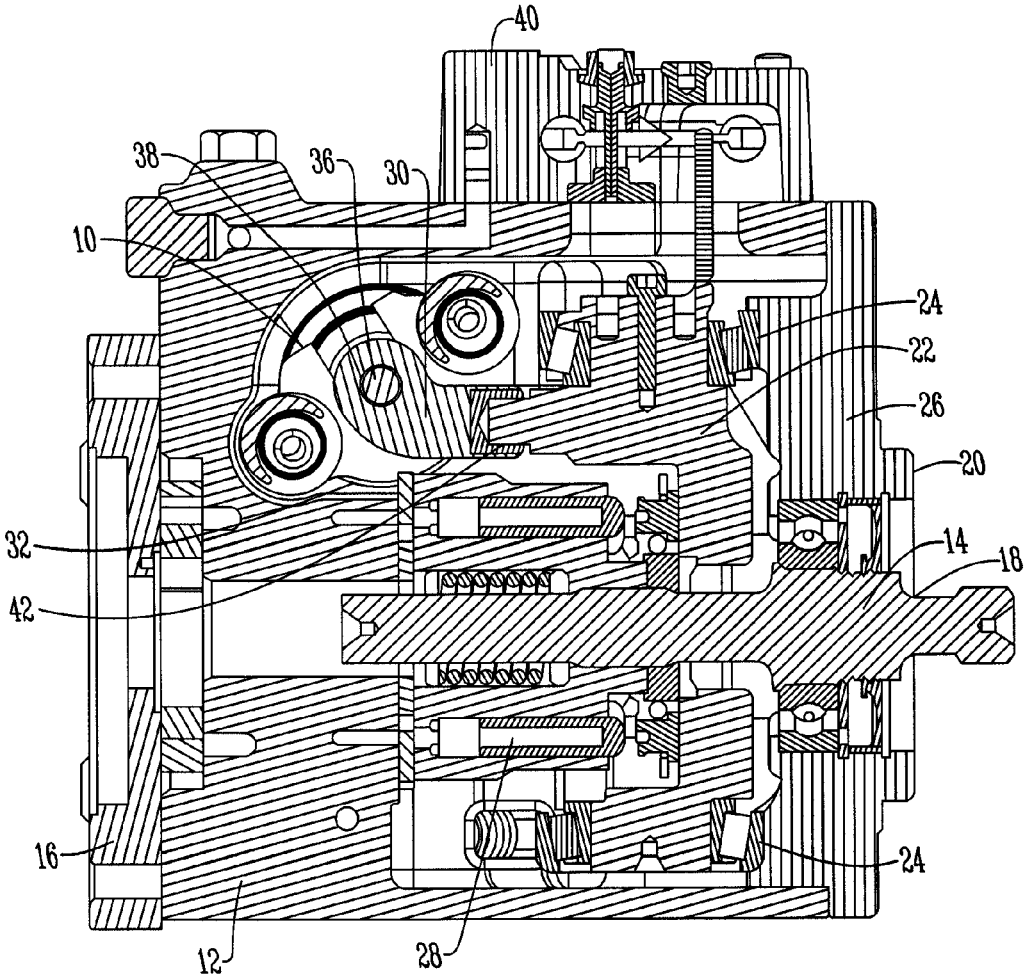
FIG. 1 is a side sectional view of a servo piston assembly in a hydraulic system.
Figure 2:
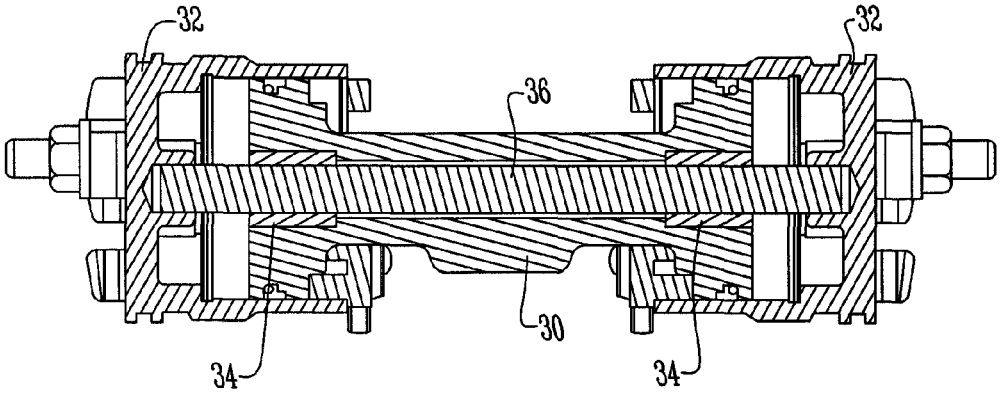
FIG. 2 is a side sectional view of a servo piston assembly.
Figure 3:
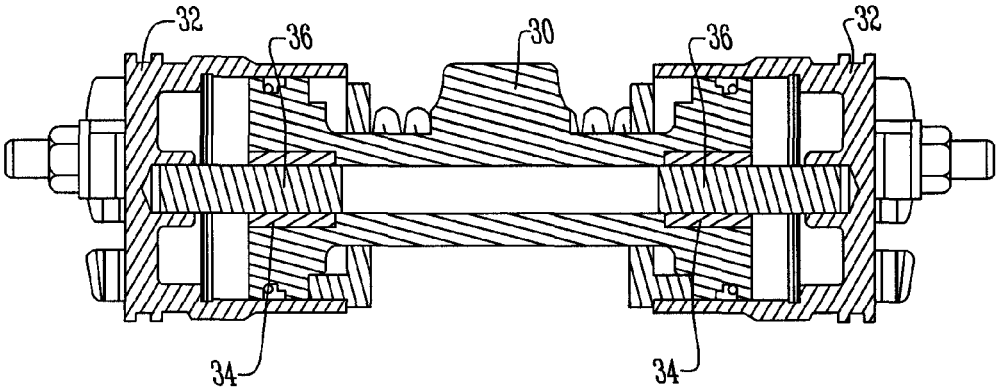
FIG. 3 is a side sectional view of a servo piston assembly.

Referring to the Figures, a low friction compact servo piston assembly 10 used in a housing 12. The housing 12 may be a separate end cap and housing or integrated into a single piece. Disposed within the housing 12 is a shaft 14. The shaft 14 is rotatably connected to a cover 16 of the housing 12 and extends through an opening 18 in the opposite sidewall 20. Proximate to the shaft 14 is a swashplate 22 that has swashplate bearings 24 positioned between the swashplate 22 and a mounting flange 26. The mounting flange 26 is a separate piece or integral with housing 12.

The swashplate bearings 24 are of any type such as semicircular cradle type, fully round, tapered roller, cylindrical roller, needle roller, journal bearings or the like. Also slidably mounted to the shaft 14 is a rotating kit 28.

Connected to the swashplate 22 is a servo piston 30. The servo piston is mounted within a servo cylinder 32 that is a separate piece or integral with the housing 12. The servo piston 30 has a pair of bushings 34 within each end of the piston 30 and the piston 30 has a guide rod 36 that extends through a centrally located bore 38 within the piston 30. Alternatively, instead of extending all the way through piston 30, a pair of guide rods 36 are cantilevered from within the servo cylinder 32. The servo piston 30 is connected to and controlled by controller 40.

In operation, the internal guide rod 36 supports the servo piston 30 on low friction bushings 34 that preferably are made of metal or polymer. Other types of linear guidance bearing types may be used such as, for example, linear ball bearings. This design allows for a very compact pump design because the servo piston 30 is very close to the cylinder block and the swashplate bearings 24 which may be fully round as opposed to cradle bearings. This further allows for a combination of low cost bearing/swashplate components and small package size for high power density. The low cost is achieved because a tipping moment is induced on the servo piston 30 due to the distance between the piston and swashplate connection point 42 and the translation axis of the piston 30. Reducing the tipping moment would result in friction and an increased package size of the pump. This internal guidance does not add width to the servo piston (30), and likewise the pump, like external guidance systems.

Therefore, a low friction solution to provide linear guidance of a servo piston so that a small package size can meet performance goals has been disclosed that at the very least meets all of the stated objectives.

What is claimed is:

1. A servo piston assembly, comprising:

a transverse axis servo piston mounted within a servo piston cylinder;

a pair of bushings connected within each end of the servo piston;

a bore that extends through the servo piston;

a guide rod that is received within the bore and extends beyond the servo piston and is fully contained within the servo piston cylinder;

wherein the guide rod includes a pair of rods cantilevered from within the servo piston cylinder; and wherein during operation a tipping moment is induced on the servo piston due to the distance between the piston and a swashplate connection point and a translation axis of the piston.

2. The assembly of claim 1 wherein the pair of bushings are linear ball bearings.

3. The assembly of claim 1 wherein the servo piston is connected to a swashplate having swashplate bearings positioned between the swashplate and a mounting flange.

4. The assembly of claim 3 wherein the swashplate bearings are fully round.

5. The assembly of claim 1 wherein the servo piston cylinder is integral with a housing.

* * * * *